US005579088A

United States Patent [19]

Ko

[11] Patent Number: 5,579,088

[45] Date of Patent: Nov. 26, 1996

[54] IMAGE FORMING APPARATUS HAVING PROGRAMMABLE DEVELOPER CARTRIDGE

[75] Inventor: Chang-Kyung Ko, Suwon, Rep. of Korea

[73] Assignee: SamSung Electronics Co., Ltd., Kyungki-do, Rep. of Korea

[21] Appl. No.: 366,556

[22] Filed: Dec. 30, 1994

[30] Foreign Application Priority Data

Dec. 31, 1993 [KR] Rep. of Korea ..... 31813/1993

[51] Int. Cl.[6] ..... G03G 21/00

[52] U.S. Cl. ..... 355/203; 355/260

[58] Field of Search ..... 355/200, 203, 355/204, 206, 209–211, 260; 364/525, 550; 377/2, 15, 16

[56] References Cited

U.S. PATENT DOCUMENTS

| | | | |
|---|---|---|---|
| 4,851,875 | 7/1989 | Tanimoto | 355/211 X |
| 4,961,088 | 10/1990 | Gilliland et al. | 355/206 |
| 4,963,939 | 10/1990 | Kurando et al. | 355/260 |
| 5,075,724 | 12/1991 | Wada et al. | 355/203 |
| 5,270,773 | 12/1993 | Sklut et al. | 355/201 |
| 5,283,613 | 2/1994 | Midgley, Sr. | 355/203 |
| 5,300,761 | 4/1994 | Kasahara et al. | 235/375 |

FOREIGN PATENT DOCUMENTS

| | | |
|---|---|---|
| 0589130A2 | 3/1993 | European Pat. Off. . |
| 61-90169 | 5/1986 | Japan . |
| 62-113164 | 5/1987 | Japan . |
| 2-73284 | 3/1990 | Japan . |

*Primary Examiner*—William J. Royer
*Attorney, Agent, or Firm*—Robert E. Bushnell, Esq.

[57] ABSTRACT

A device and method for driving a developing unit in an image forming apparatus having a programmable developer cartridge capable of locking the developing unit for use only by an authorized user. A device for locking an article of consumption in an image forming apparatus includes a first memory device connected to the article of consumption, for storing a first identification code therein; a second memory device disposed in the image forming apparatus; and a controller for controlling the driving of the article of consumption, the control unit including the second memory device for storing a predetermined identification code and a locking device for generating a release signal which drives the article of consumption, when the first identification code read from the first memory device corresponds to the predetermined identification code read from the second memory device.

19 Claims, 3 Drawing Sheets

IMAGE FORMING APPARATUS HAVING PROGRAMMABLE DEVELOPER CARTRIDGE

CROSS-REFERENCE TO RELATED APPLICATIONS

This application makes reference to, incorporates the same herein, and claims all benefits incurring under 35 USC §119 from an application for Image Forming Apparatus Having Programmable Developer Cartridge filed in the Korean Industrial property office on 31 December 1993 and assigned Ser. No. 1993/31813.

BACKGROUND OF THE INVENTION

1. Technical Field

The present invention relates a device and method for driving a developing unit in an image forming apparatus, and more particularly to the image forming apparatus such as an electrophotographic copying machine or a printer having a detachable and programmable developer cartridge capable of preventing unauthorized usage of the developer cartridge in the image forming apparatus.

2. Background Art

Conventionally, the image forming apparatus such as an electrophotographic copying machine, facsimile machine or printer includes means for preventing a person other than the authorized users from using the image forming apparatus. For example, in U.S. Pat. No. 5,300,761 for Image Forming Apparatus Counting System Using Individual And Collective Counters, Kasahara et al. employ a registering device for registering a plurality of identification codes and a comparing device for comparing the authorized user's pre-assigned identification code stored in a detachable and portable memory CARD with the plurality of identification codes registered in the registering device so as to enable the authorized user to operate the image forming apparatus. Similarly, in European Patent No. 0 589 130 A2 for Image Forming Apparatus Using ID Card Having Counter, Ogura uses a memory CARD for storing the user's ID code so as to enable the user to access the copier when the user's identification code matches a predetermined identification code registered in the copier.

The image forming apparatus described in Japanese Patent Publication Nos. 2-73284 and 60-113164 issued to Ishii and Osako however requires the user to directly enter his own identification code for a match with a registered identification code prior to operating the copier. Specifically, in Japanese Patent Publication No. 2-73284, Ishii requires the user to directly enter his pre-assigned identification code into the copier so that the copier could compare the user's entered identification code with a registered identification code in order to release the copy inhibition mode. In Japanese Patent Publication No. 60-113164, Osako further requires the user to reserve his own identification code in the copier before he could release the operation stop state for copying. In the event if the user does not reserve his own identification code in the copier, however, the use of the copier is prohibited.

Another unauthorized access prevention technique is disclosed in U.S. Pat. No. 5,270,773 for Image Producing Device With Security To Prevent Disclosure of Sensitive Documents issued to Sklut et al. In Sklut '773, an operator password login system is used in conjunction with an image forming apparatus where access to machine copy functions is prohibited until an appropriate operator password has been entered and validated.

In these unauthorized access prevention schemes, however, the objective is to prevent unauthorized users from operating the image forming apparatus. It has been my observation that none of these efforts accommodate security to the individual articles of consumption within the image forming apparatus themselves such as, for example, a developing unit, a photosensitive drum unit, a toner, etc., all of which are detachable and exchangeable upon depletion because of continuous and repeated uses.

For example, commercial developing units typically have different prices depending upon the printing resolution such as 300 dpi or 600 dpi, or dependent upon whether they are used in conjunction with high quality toner or general toner. Consequently, if the user has the developing unit comprising high quality toner with high resolution of 600 dpi, he would want to control the usage of the developing unit in order to conserve the life of the developing unit and reduce cost. The user would therefore appreciate the necessity of controlling the usage of the developing unit,in order for example, to prevent an unauthorized person from using his own developing unit. Such necessity would further be appreciated by commercial manufacturers who manufacture their own models of image forming apparatus using particular types of developing units. In a conventional image forming apparatus, if an unauthorized person uses different models of developing units without permission of its owner, the image forming apparatus itself could be damaged and the printing quality could be deteriorated. Consequently, operation of the image forming apparatus becomes unreliable, and damages would inevitably arise whenever exchangeable parts having limited life spans, such as a toner hopper, a developing unit, a photosensitive drum unit are used in the image forming apparatus.

SUMMARY OF THE INVENTION

It is therefore an object of the present invention to provide a device and method for locking detachable expendable in an image forming apparatus so as to prevent unauthorized users from using the expendables in the image forming apparatus.

It is another object of the present invention to provide a device and method for driving detachable expendables so as to control usage of only the detachable expendable as real products in an image forming system.

To achieve these and other objects, a device for locking expendable according to the present invention includes a first memory disposed in a detachable article of consumption such as a toner hopper, a developing unit and photosensitive drum unit, for storing a particular identification code therein; a control unit disposed in an image forming apparatus and comprising a second memory for storing a predetermined identification code and a locking device for generating a release signal enabling the control unit to drive the detachable article of consumption for image formation, when the identification code stored in the article of consumption matches the identification code stored in the control unit.

Similarly, the method for locking a detachable article of consumption in an image forming apparatus according to the present invention includes registering a first identification code in the detachable article of consumption such as a toner hopper, a developing unit and photosensitive drum unit, and separately registering a second identification code in a control unit of the image forming apparatus; reading the first identification code registered in the detachable article of consumption by the control unit to determine whether the first identification code matches said second identification code registered in the control unit in dependence upon reception of a print command entered by the user; and driving the detachable article of consumption by the control unit to enable operation of the image forming apparatus, when the first identification registered in the detachable article of consumption matches the second identification code registered in the control unit. The method also includes displaying an identification code input request message to alert a user to register the first and second identification codes in the control unit and the detachable article of consumption prior to registering the first and second identification codes.

Another embodiment of the present invention requires the manufacturer rather than the user to initially register company identification codes with the detachable article of consumption and the control unit of the image forming apparatus so as to prevent unauthorized circulation of imitations of the detachable article of consumption by enabling the image forming apparatus to form images when the detachable article of consumption contains an identification code that matches with the company identification code registered in the control unit of the image forming apparatus.

The present invention is more specifically described in the following paragraphs by reference to the drawings attached only by way of example.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
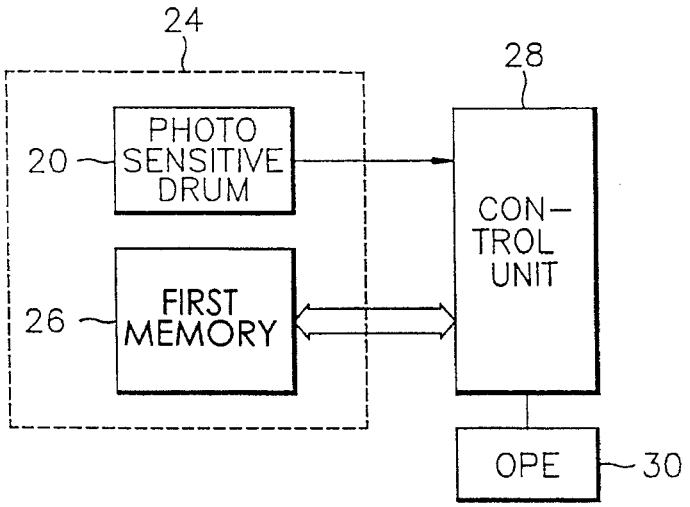
FIG. 1 is a block diagram illustrating a construction of an image forming apparatus using an electrophotographic developing process according to the present invention.

Referring now to the drawings and particularly to FIG. 1, an image forming apparatus using an electrophotographic developing process employed in the present invention includes a developing unit 24, a control unit 28 and an operational panel 30 (hereinafter referred as "OPE"). Developing unit 24 serves to develop the image by the electrophotographic developing process, and includes a first memory 26 for storing a particular identification code (i.e., personal identification information) and a photosensitive drum 20. Control unit 28 serves to control the image forming process of the apparatus, particularly, the driving of the developing unit 24, and includes a second memory (not shown) for storing a predetermined identification code. Alternatively, the second memory could be arranged outside of the control unit 28, but inside of the image forming apparatus as long as it is separated from the first memory in the consumption goods. The OPE 30 has various kinds of keys, for example, a plurality of numeral keys, menu key, on-line key, enter key, etc. and is used to display key input to inform the user the process of establishing code data to the developing unit 24 and control unit 28 and to illustrate the driving of the developing unit 24.

Figure 2:
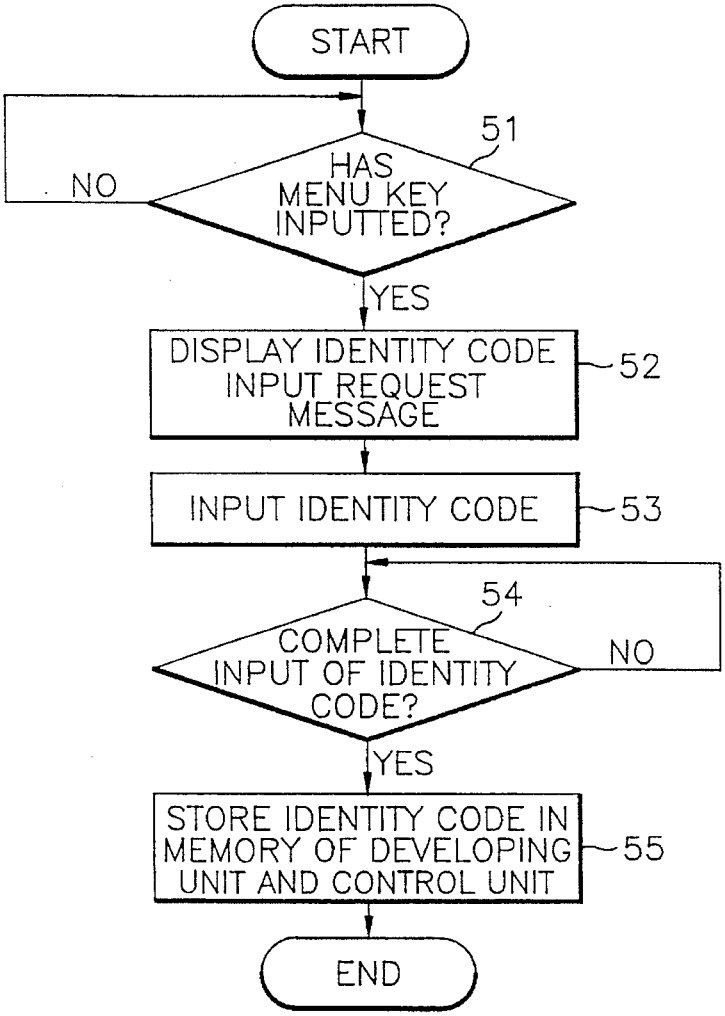
FIG. 2 is a flow chart illustrating a registration process of an identification code according to the present invention.

FIG. 2 illustrates an identification code registration process of an image forming apparatus according to the present invention. First, the control unit 28 determines whether an identification code registration menu key is input. If the identification code registration menu key is input, an identification code input request message is displayed on the OPE 30 to request the user to register either his own identification code in the first memory 26 of the developing unit 24, or a matching identification code in the second memory (not shown) of the control unit 28. When the identification code is input, the input identification code is stored either in the first memory 26 of the developing unit 24, or in the second memory (not shown) of the control unit 28. Both identification codes for the developing unit 24 and the control unit 28 could be registered in the image forming apparatus either simultaneously or separately. The identification code registration menu key could be embodied in a single key input on the OPE 30, or embodied in a combination of several key inputs on the OPE 30, for example, an on-line key and an enter key.

Figure 3:
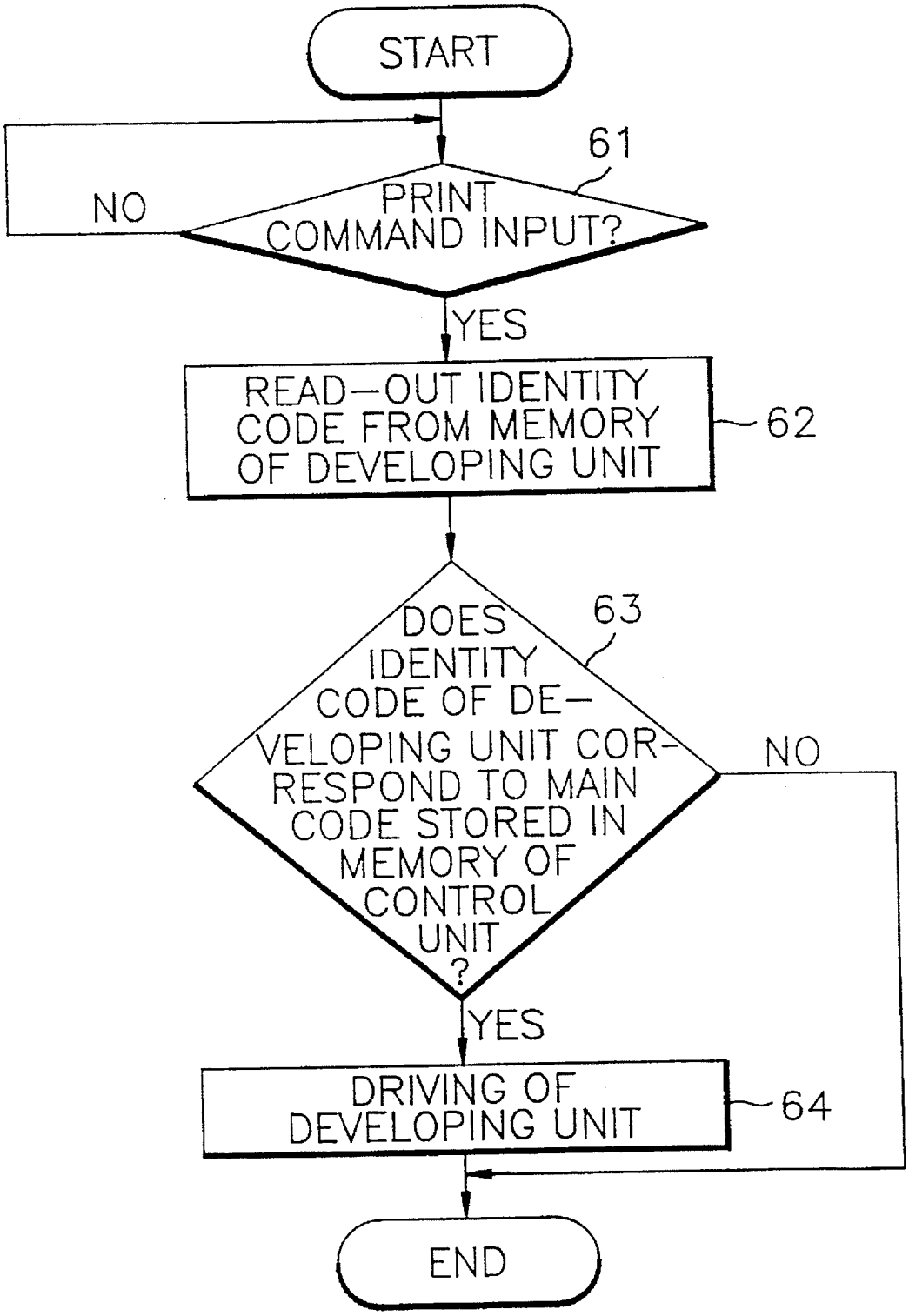
FIG. 3 is a flow chart illustrating an embodiment of the present invention.

FIG. 3 illustrates the driving process of the developing unit 24 by the control unit 28 according to one embodiment of the present invention. After the identification codes are registered in the control unit 28 and developing unit 24, the control unit 28 determines whether a print command is input by the user. If the print command is input by the user, the control unit 28 reads the identification code registered in the first memory 26 of the developing unit 24, and determines whether the identification code registered in the first memory 26 of the developing unit 24 corresponds to the identification code registered in the control unit 28. Only when the identification code registered in the developing unit 24 corresponds to the identification code registered in the control unit 28, the control unit 28 drives the developing unit 24 to begin the image forming process; otherwise, the control unit 28 would not drive the developing unit 24, and thereby preventing unauthorized person from using the developing unit 24.

The operation of the image forming apparatus shown in FIG. 1 is further explained with reference to the flowchart shown in FIG. 2. First, the control unit 28 checks whether the menu key is input from the OPE 30 in step 51. If the menu key is input from the OPE 30, the control unit 28 proceeds to step 52 to display the identification code input request message, for example, "code=0000" on the display device of the OPE 30. Then, the control unit 28 proceeds to step 53 to scan the OPE 30 for detecting the establishment of the identification code input by the user via increment or decrement keys from the OPE 30. After the identification code is input in step 53, the control unit 28 determines whether the input of the identification code is completed in step 54. To determine whether the input of the identification code is completed, the control unit 28 determines whether an enter key from the OPE 30 is pressed by the user. That is, if the enter key from the OPE 30 is not pressed by the user, the control unit 28 notes that the input of identification code is not completed. If the enter key from the OPE 30 is however pressed by the user, the control unit 28 proceeds to step 55 to store the input identification code into the first memory 26 of the developing unit 24 and/or the internal memory of the control unit 28, respectively.

If necessary, the identification code registration process is separately controlled by either the user or the manufacturer. That is, the identification codes set by the user and the manufacturer could be simultaneously stored in the memory installed in the article of consumption. During the manufacture of the article of consumption, the manufacturer could set the company identification code in a region of the memory different from the region storing the identification code set by the user in the same manner as shown in FIG. 2. In addition, when the manufacturer sets the company identification code, he could also arrange the identification code registration menu key different from that set by the user and retain the company identification code from the users. Consequently, the identification code registration process could be separately controlled by the user and the manufacturer. For example, when the power is turned-on, if a given key is pressed, the identification code registration mode for the manufacturer is performed. Here, the combination of the input key is provided so as to keep the company identification code secret from other persons except the manufacturer. For example, the memory area used by the manufacturer to store the company identification code may be a ROM that prohibits re-writing of any other identification codes except himself.

Moreover, if the identification code is to be modified or changed, an identification code extension process could be additionally executed. A principal object of such process, however, is to prevent the identification code from being changed by a third person. For example, upon purchasing the image forming apparatus, the image forming apparatus has an initial identification code value. This initial identification code value is input by the manufacturer and then supplied to the user. Consequently, the user who purchases the image forming apparatus cannot enter his own identification code without knowing the initial identification code value set by the manufacturer. In other words, at step 51 of FIG. 2, when the menu key and identification code are input by the user in an attempt to change the identification code initially entered by the manufacturer, if the input identification code does not match the initial identification code, the image forming apparatus remains disabled; otherwise, the image forming apparatus proceeds to next step, if the input identification code matches the initial identification code. Such process is applied in the inputting of the user's initial identification code as well as in the changing of the identification code, so that unauthorized input or alteration of the identification code can be prevented.

In addition, an identification code confirming process can be further performed after changing the identification code. An object of such a process is to prevent the input of identification code made by mistake. In the identification code confirming process, the input identification code is displayed on a display device and the identification code can be confirmed (i.e., if the identification code is "0000," the identification code is displayed and the input of enter key is required). Further, only if a plurality of times of the identification code are input and all the input identification codes correspond to each other, the identification code can be changed as an input identification code. Such operation is performed following step 53 of FIG. 2.

FIG. 3 illustrates the driving operation of the developing unit 24 by the control unit 28 when the identification code is registered, as discussed above. According to the present invention, the identification code registered in the developing unit could be checked when the power is turned-on, or when a printing command is entered by the user via the OPE 30. In FIG. 3, the identification code registered in the developing unit is checked when a printing command is entered by the user via the OPE 30. Specifically, in step 61, the control unit 28 checks whether the print command is input by the user. If the print command is input by the user, the control unit 28 reads the identification code registered in the developing unit 24 to determine whether the identification code read from the developing unit 24 corresponds to an identification code registered in a memory (not shown) of the control unit 24. If the identification code read from the developing unit 24 corresponds to the identification code registered in the control unit 28 of the image forming apparatus, the control unit 28 drives the developing unit 24 to form images; otherwise, the control unit 28 rejects the print command entered by the user.

The operation of the image forming apparatus shown in FIG. 1 is further explained with reference to the flowchart shown in FIG. 3. First, the control unit 28 checks whether a print command is input by the user via a host computer (not shown) in step 61. If the print command is input by the user via the host computer, the control unit 28 reads the identification code registered in the first memory 26 of the developing unit 24 in step 62 and then proceeds to step 63. At step 63, the control unit 28 checks whether the identification code registered in the first memory 26 of the developing unit 24 corresponds to a main identification code registered in a memory of the control unit 28. If the identification code registered in the developing unit 24 does not correspond to the main identification code registered in the control unit 28, the control unit 28 rejects the print command and does not drive the developing unit 24 to form images. On the other hand, if the identification code registered in the developing unit 24 corresponds to the main identification code registered in the control unit 28, the control unit 28 drives the developing unit 24 in step 64 to perform a printing operation. The operational process of FIG. 3 is applicable to both of the user and the manufacturer.

Figure 4:
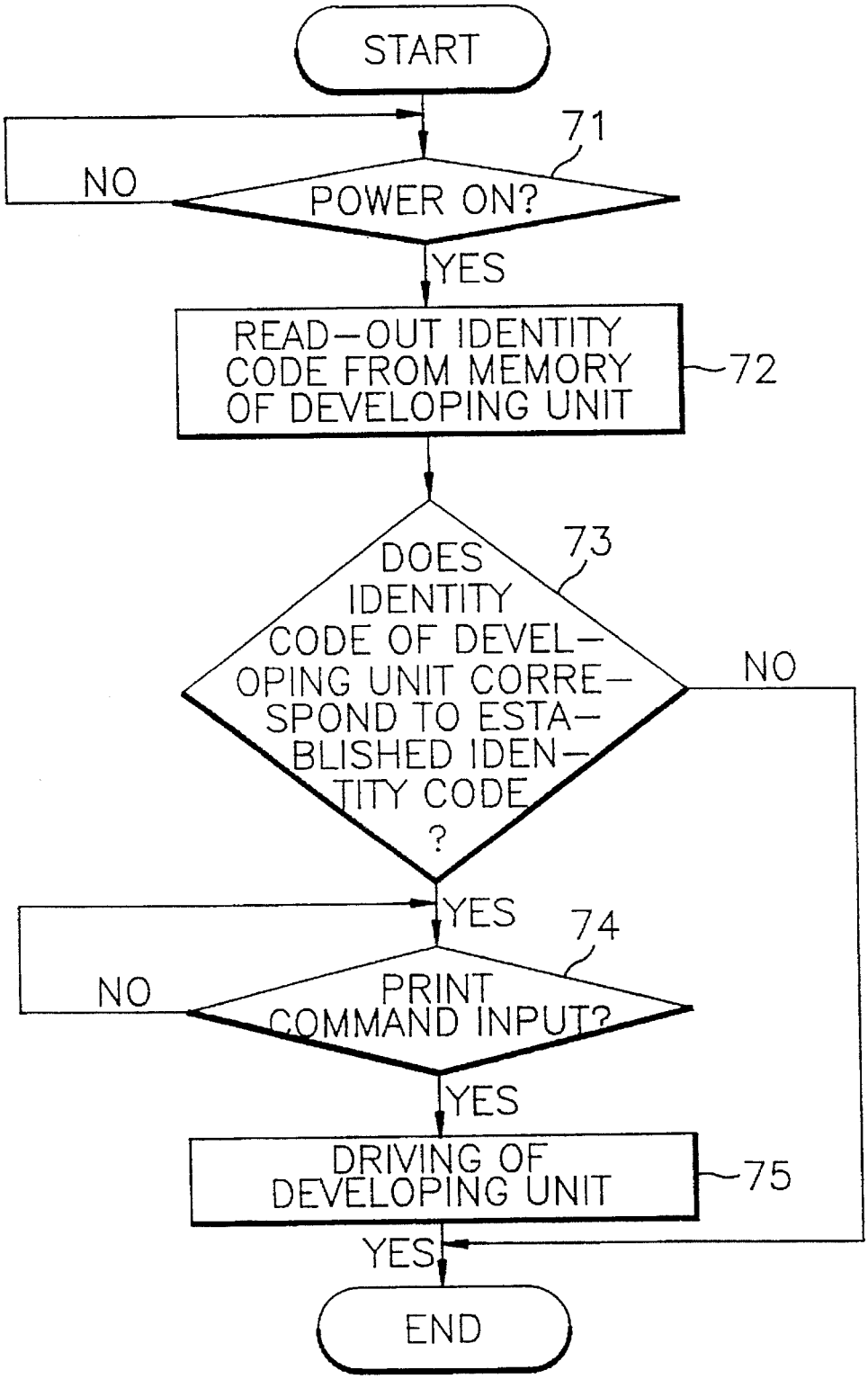
FIG. 4 is a flow chart illustrating another embodiment of the present invention.

FIG. 4 illustrates another driving operation of the developing unit of the present invention. In FIG. 4, the identification code registered in the developing unit 24 is checked when the power is turned-on, rather than when the print command is input by the user. When the power is turned-on in step 71, the control unit 28 reads the identification code registered in the developing unit 24 to determine whether the identification code read from the developing unit 24 corresponds to an established identification code registered in the control unit 28. Here, again, if both identification codes correspond to each other, the control unit 28 drives the developing unit 24 upon reception of a print command entered by the user; otherwise, the control unit 28 refuses to drive the developing unit 24 for forming images.

The operation of FIG. 4 is further explained with reference to FIG. 1 as follows. For convenience, it is assumed that company identification codes are stored in the control unit 28 and developing unit 24. At step 71, the control unit 28 checks whether the power is turned-on. If the power is turned-on, the control unit 28 reads the identification code registered in the first memory 26 of the developing unit 24 in step 72. Thereafter, at step 73, the control unit 28 checks whether the identification code read from the first memory 26 of the developing unit 24 corresponds to the company identification code stored in a memory of the control unit 28. Here, if both identification codes do not correspond to each other; that is, if the identification code registered in the developing unit 24 does not match with the company identification code set by the manufacturer in the control unit 28, the control unit 28 does not drive the developing unit 24, thus forming no image. If the identification code of the developing unit 24 matches the company identification code set by the manufacturer, however, the control unit 28 proceeds to step 74 to monitor whether a print command is input by the user via a host computer. If the print command is input by the user, the control unit 28 drives the developing unit 24 to perform a printing operation in step 75. As a matter of practicality, a manufacturer may use both methods of FIG. 3 and FIG. 4 as mentioned above, in combination or selectively. Further, the method as set forth in FIG. 3 may be used for user's identification code, while the method as set forth in FIG. 4 may be used for manufacturer's identification code, independently.

As discussed above, the locking device and method according to the present invention establishes matching identification codes between the developing unit 24 and the control unit 28 of the image forming apparatus prior to forming any images. Only when the identification code registered in the developing unit 24 corresponds to the identification code registered in the control unit 28, the control unit 28 can drive the developing unit 24 to perform a printing operation, thereby enabling the owner to prevent unauthorized persons from using the developing unit. Furthermore, the manufacturer can design and store his company identification code in the developing unit not only for his trademark purposes, but also for the purpose of preventing unauthorized circulation of imitations of his products if the identification code of the developing unit does not correspond to his company code stored in the control unit of the image forming apparatus.

The developing unit 24 as shown in FIGS. 1–4 is used only as one example of an article of consumption. As mentioned earlier, the article of consumption used in conjunction with an image forming apparatus could also be a toner hopper, a developing roller, a photosensitive drum unit or any other detachable and exchangeable articles used inside the image forming apparatus. As may be apparent from the above descriptions, a locking device and method according to the present invention is also applicable to the toner hopper, the developing roller and photosensitive drum unit so long as these detachable articles of consumption are capable of storing identification code that can be identified by the control unit of the image forming apparatus.

Consequently, while preferred embodiments of the invention have been particularly shown and described, it will be understood by those skilled in the art that the foregoing and other changes in form and details may be made without departing from the spirit and scope of the invention as defined in the appended claims and that it may be possible, for example, to register matching identification code in a toner, a developing roller etc . . . Furthermore, the principles of the present invention are also directly applicable to printers and facsimile machines.

What is claimed is:

1. A device for locking a detachable article of consumption in an image forming apparatus, said device comprising:

first memory means connected to said detachable article of consumption, for storing a first identification code therein;

second memory means disposed in said image forming apparatus, for storing a predetermined identification;

control means for controlling the driving of said detachable article of consumption, said control means comprising locking means for generating a release signal enabling driving said detachable article of consumption, when said first identification code read from said first memory means corresponds to said predetermined identification code stored in said second memory means; and key input means for inputting first code data representative of said first identification code to be stored in said first memory means, and for inputting second code data representative of said predetermined identification code to be stored in said second memory means.

2. The device as claimed in claim 1, further comprising display means for displaying said first code data to be stored in said first memory means connected to said detachable article of consumption and said second code data to be stored in said second memory means under control of said control means.

3. The device as claimed in claim 2, further comprised of said control means controlling storing of said first identification code in said first memory means connected to said detachable article of consumption by:

determining whether a menu key is input from said key input means;

displaying an identification code input request message on said display means;

determining whether said first identification code is input from said key input means; and storing said first identification code in said first memory means connected to said detachable article of consumption.

4. The device as claimed in claim 3, further comprised of said control means controlling storing of said predetermined identification code in said second memory means by:

determining whether a menu key is input from said key input means;

displaying an identification code input request message on said display means;

determining whether said predetermined identification code is input from said key input means; and storing said predetermined identification code in said second memory means.

5. The device as claimed in claim 2, wherein said control means drives said detachable article of consumption in said image forming apparatus by:

determining whether a print command is entered by a user;

reading said first identification code stored in said first memory means connected to said article of consumption;

determining whether said first identification code read from said first memory means corresponds to said predetermined identification code stored in said second memory means; and driving said article of consumption to begin forming images when said first identification code read from said first memory means corresponds to said predetermined identification code stored in said second memory means.

6. The device as claimed in claim 2, wherein said control means drives said detachable article of consumption in said image forming apparatus by:

determining whether a power is turned-on;

reading said first identification code stored in said first memory means connected to said article of consumption;

determining whether said first identification code read from said first memory means corresponds to said predetermined identification code stored in said second memory means;

determining whether a print command is entered by a user, when said first identification code read from said first memory means corresponds to said predetermined identification code stored in said second memory means; and driving said article of consumption to begin forming images upon reception of said print command entered by the user.

7. The device as claimed in claim 6, further comprised of said article of consumption comprising one of a photosensitive drum, a toner hopper, and a developing roller.

8. The device as claimed in claim 1, further comprised of said article of consumption comprising a photosensitive drum.

9. The device as claimed in claim 1, further comprised of said article of consumption comprising a toner hopper.

10. The device as claimed in claim 1, further comprised of said article of consumption comprising a developing roller.

11. A method for driving an image forming apparatus comprising a control unit, an operational panel comprising a plurality of input keys, and a detachable article of consumption, said method comprising the steps of:

registering a first identification code and a second identification code in said control unit and said detachable article of consumption, respectively, in response to a registration input by a user via said operational panel;

reading said first identification code registered in said detachable article of consumption by said control unit to determine whether said first identification code corresponds to said second identification code registered in said control unit; and enabling operation of said detachable article of consumption by said control unit, when said first identification code registered in said detachable article of consumption matches said second identification code registered in said control unit.

12. The method as claimed in claim 11, further comprising the step of displaying an identification code input request message to alert a user to register the first and second identification codes in said control unit and said detachable article of consumption prior to registering said first and second identification codes.

13. The method as claimed in claim 11, wherein said first identification code registered in said detachable article of consumption is read by said control unit when the power of said image forming apparatus is turned-on.

14. The method as claimed in claim 11, wherein said first identification code registered in said detachable article of consumption is read by said control unit when the user enters a print command.

15. An apparatus for preventing unauthorized access to a programmable developer cartridge in an image forming apparatus including key input means, said apparatus comprising:

said programmable developer cartridge comprising a first memory for registering a first identification code, said programmable developer cartridge being attachable and detachable from said image foraging apparatus; and a controller comprising a second memory for registering a second predetermined code, said controller being disposed in said image forming apparatus for controlling the registration of said first and second identification codes in response to a registration input by a user via said key input means, and for controlling the driving of said programmable developer cartridge enabling said image forming apparatus to form images on a printable medium.

16. The apparatus as claimed in claim 15, wherein said controller controls the registration of said first identification code in said first memory of said programmable developer cartridge by:

determining whether a menu key is input by the user from said key input means;

displaying of an identification code input request message on display means;

determining whether said first identification code is input by the user from said key input means; and registering said first identification code in said first memory of said programmable developer cartridge.

17. The apparatus as claimed in claim 15, wherein said controller controls the registration of said second identification code in said second memory of said controller by:

determining whether a menu key is input by the user from said key input means;

displaying of an identification code input request message on display means;

determining whether said second identification code is input by the user from said key input means; and registering said second identification code in said second memory.

18. The apparatus as claimed in claim 15, wherein said controller drives said programmable developer cartridge enabling said image forming apparatus to form images on said printable medium by:

determining whether a print command is entered by the user via said key input means;

reading said first identification code registered in said first memory contained in said programmable developer cartridge;

determining whether said first identification code read from said first memory matches said second identification code registered in said second memory contained in said controller; and driving said programmable developer cartridge to begin forming images on said printable medium when said first identification code read from said first memory matches said second identification code registered in said second memory.

19. The apparatus as claimed in claim 15, wherein said controller drives said programmable developer cartridge enabling said image forming apparatus to form images printable medium by:

determining whether a power is turned-on;

reading said first identification code registered in said first memory contained in said programmable developer cartridge;

determining whether said first identification code read from said first memory matches said second identification code registered in said second memory contained in said controller;

determining whether a print command is entered by the user via said key input means, when said first identification code read from said first memory matches said second identification code registered in said second memory; and driving said programmable developer cartridge to begin forming images on said printable medium upon reception of said print command entered by the user.

* * * * *

UNITED STATES PATENT AND TRADEMARK OFFICE

CERTIFICATE OF CORRECTION

PATENT NO. : 5,579,088

DATED : 26 November 1996

INVENTOR(S) : Chang-Kyung KO

It is certified that error appears in the above-indentified patent and that said Letters Patent is hereby corrected as shown below:

Column 1, line 12, after "Industrial", change "property office" to --Property Office--; and Column 2, Line 40, after "detachable", change "expendable" to --expendables--:

Signed and Sealed this

Twenty-fourth Day of June, 1997

Bruce Lehman

*Attest:*

BRUCE LEHMAN

*Attesting Officer*

*Commissioner of Patents and Trademarks*